United States Patent [19]

MacAnlis

[11] Patent Number: 4,535,337

[45] Date of Patent: Aug. 13, 1985

[54] CROSS POLARIZED WIRE GRID ANTENNA

[76] Inventor: David H. MacAnlis, Rte. 2, Box 282A4, Berryville, Va. 22611

[21] Appl. No.: 527,723

[22] Filed: Aug. 30, 1983

[51] Int. Cl.[3] ..... H01Q 11/04

[52] U.S. Cl. ..... 343/737; 343/797; 343/897

[58] Field of Search ..... 343/731–737, 343/797, 798, 831, 814, 897

[56] References Cited

U.S. PATENT DOCUMENTS 3,541,564 11/1970 Fisk ..... 343/797

4,293,858 10/1981 Hockham ..... 343/731

*Primary Examiner*—Eli Lieberman

*Attorney, Agent, or Firm*—Sughrue, Mion, Zinn, Macpeak and Seas

[57] ABSTRACT

A cross polarized wire grid antenna is disclosed which produces circularly polarized electromagnetic radiation. A subarray layer of the present invention comprises a plurality of interconnected rectangular elements. The elements are connected and fed so that the short sides of the rectangles serve essentially as radiating elements, and the long sides of the rectangles serve essentially as nonradiating transmission line elements. In an embodiment of the present invention, a first subarray comprises two layers of horizontally polarized radiators and a second subarray comprises two layers of vertically polarized radiators. The two subarrays are combined to form a cross-polarized antenna array which produces circularly polarized electromagnetic radiation. The layers of each subarray are electrically isolated from one another and are displaced $\frac{1}{2}\lambda$ with respect to each other perpendicular to the direction of polarization of the subarray. The layers of each subarray are fed in-phase with respect to each other, and each subarray is fed 90° out of phase with respect to the other. Feed can be provided between the layers of a subarray by providing balanced two-wire feed to one layer at the broken center of a first radiating feed element and cross-coupling the first feed element to the immediately adjacent second radiating feed elements of the other layer of the subarray.

17 Claims, 9 Drawing Figures

CROSS POLARIZED WIRE GRID ANTENNA

BACKGROUND OF THE INVENTION

1. Field of the Invention

The present invention relates generally to antenna systems and, more particularly, to an antenna system which produces circularly polarized electromagnetic radiation from a plurality of planar wire grid antennas.

2. Description of the Prior Art

The polarization of an electromagnetic wave can be defined as the directivity and relative motion in space of its associated electric field vector. A "linearly polarized" wave has an associated field vector which describes a line in space (i.e. a vector having no relative motion), and a "circularly polarized" wave has an associated field vector which describes a circle in space (i.e. the field vector has a relative circular motion). The polarization of an antenna is defiend as the resultant plane of propagation of the radiated electromagnetic wave. Where the antenna is oriented such that the direction of propagation is parallel to the plane of the earth, a "horizontally polarized" antenna is one in which the plane of propagation of the wave is parallel to the plane of the earth, and a "vertically polarized" antenna is one in which the plane of propagation of the wave is perpendicular to the plane of the earth. Circularly polarized waves may be produced by the interaction between linearly polarized waves of horizontal and vertical polarizations. In order to achieve proper circular polarization, the horizontally polarized radiating elements and the vertically polarized radiating elements must be perpendicular with respect to each other, fed in phase quadrature, and must radiate at equal electromagnetic intensities; that is, the linearly polarized waves of horizontal polarization and the linearly polarized waves of vertical polarization must be equal in magnitude, orthogonal in orientation, and in time quadrature with respect to each other. If any of these three conditions are not met, elliptically polarized radiation will be produced.

Antennas which produce circularly polarized electromagnetic radiation are generally well known in the prior art. Examples of such antennas are disclosed in U.S. Pat. Nos. 3,680,142 (Van Atta et al); 3,541,559 (Evans); and 4,083,051 (Woodward). In these references, circular polarization is produced by feeding orthogonal radiating elements in phase quadrature. The antennas disclosed in these references present a major antenna design constraint, because each set of orthogonal radiating elements must be separately fed. This "separate feeding" requirement increases the number of feed lines and associated support circuitry needed to produce circular polarization.

In U.S. Pat. No. 3,290,688 (Kraus) there is disclosed a wire grid antenna which produces substantially linearly polarized radiation. With reference to FIG. 1 (prior art), a grid or subarray 1 of rectangular elements is formed by conductors which form the short sides 2, 2' and the long sides 3, 3' of each rectangle. The columns of rectangles are vertically staggered and interconnected such that the short sides of the rectangles in one column connect with the midpoints 4 of the long sides of the rectangles in the adjacent column. The long sides are of a length of approximately one wavelength at the center frequency of operation, and the short sides are approximately one half wavelength long. The subarray of rectangular elements is fed at only one of two points;

namely, either at one of the intersection points 5 of a long and a short side of the rectangles along one edge of the subarray, or at one of the midpoints 6 of the short sides of any of the rectangles. By feeding the subarray at a point 5 or a point 6, the long sides of the rectangular elements act mainly as guiding or transmission line elements, while the short sides of the rectangles act as radiating elements. The long sides of the rectangular elements act as transmission line elements due to the fact that the instantaneous current in each long side 3 is equal and opposite to the instantaneous current of the opposite long side 3', whereby their associated electromagnetic radiations cancel (as shown by the arrows in FIG. 1). Likewise, the short sides act as radiators because the currents in opposite short sides 2, 2' are of the same sense, whereby their associated electromagnetic radiations are additive.

In Kraus, the single feed to the antenna at one of the points 5 is a "high impedance, unbalanced" feed, while the single feed to one of the points 6 is a "low impedance, balanced feed". The impedance of the feed is a function of the current density of the radiating element at the feed point. The "balance" of the feed is an expression relating to the grounding of the feed means. An "unbalanced" feed is produced by connecting the inner conductor of a coaxial cable to a feed point 5 and the outer conductor to the ground plane of the antenna. A "balanced" feed, on the other hand, is produced by connecting the two wires **8*a* and 8*b* of the conductor to the portions 2*a* and 2*b*, respectively, of a radiating element 2 which is open at the center thereof (i.e. at feed point 6) as shown in the lower portion of FIG. 1**. The main advantages presented by the Kraus wire grid antenna are that the rectangular grid arrangement allows a high element density to be achieved, the antenna's radiation pattern can be easily modified by changing various parameters of the conductors, and that the antenna is fed at a single feed point. Specifically, the Kraus array realizes a high radiator element density while minimizing the number of feed lines external to the antenna structure.

Heretofore, the above mentioned specific design advantages presented by the Kraus wire grid antenna have not been available for antennas which produce circularly polarized electromagnetic radiation. In addition, it has not been previously possible to further increase the radiator element density of Kraus.

SUMMARY OF THE INVENTION

Thus, the broad object of the present invention is to provide a modified Kraus wire grid antenna array to produce circularly polarized electromagnetic radiation.

Another object of the invention is to provide such an antenna in which a plurality of Kraus arrays are stacked in order to increase the radiator element density.

A further object of the invention is to provide such an antenna wherein feed means are disposed between the stacked Kraus arrays so that a stack may be fed from a single external feed line.

The above and other objects of the present invention are accomplished by forming an antenna system with at least two Kraus wire grid arrays, rotated 90° with respect to each other. Each subarray of the present invention comprises one or two layers of Kraus wire grid arrays. Each Kraus array comprises a plurality of rectangular elements which are interconnected and fed so that the short sides of the rectangles serve essentially as radiating elements, and the long sides of the rectangles serve essentially as non-radiating transmission line elements. A first subarray of horizontally polarized radiators is combined with a second subarray of vertically polarized radiators to produce circular polarization. The layers of each subarray are displaced ½ the wavelength at the center frequency of operation with respect to each other, in a direction perpendicular to the direction of polarization of the subarray. The layers of each subarray are fed in phase with respect to each other either by means of separate feed lines or by means of a single feed line and suitable cross-coupling between layers.

DETAILED DESCRIPTION OF THE PREFERRED EMBODIMENTS

Figure 1:
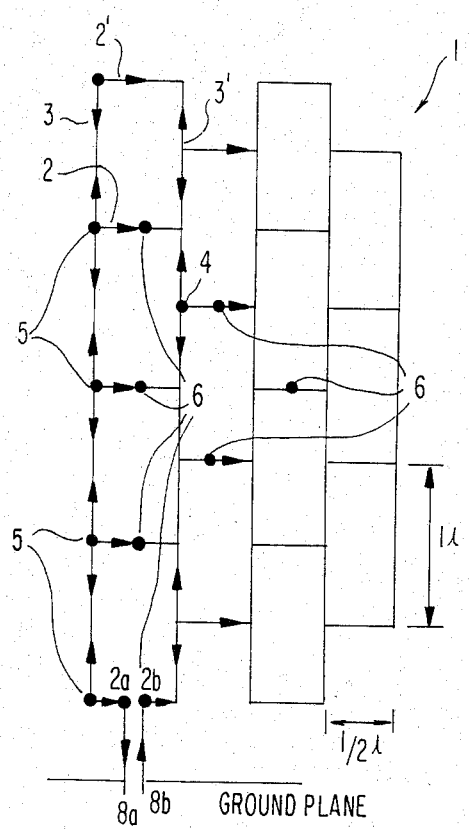
FIG. 1 (PRIOR ART)
FIG. 1 is a schematic diagram of the prior art Kraus array.
Figure 2A:
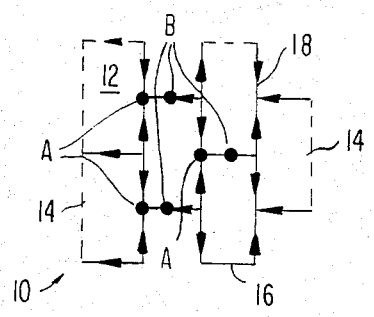
FIG. 2A is a schematic diagram of a horizontally polarized layer of one subarray of the present invention.
Figure 2B:
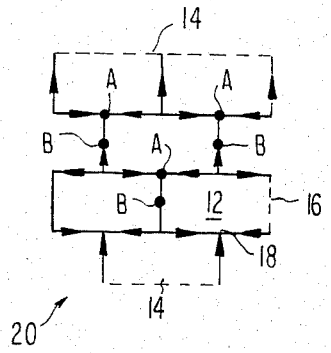
FIG. 2B is a schematic diagram of a vertically polarized layer of the other subarray of the present invention.

With reference to FIG. 2A, subarray 10 comprises a modified horizontally polarized Kraus antenna array. In the description to follow, it is to be understood that each "subarray" of the present invention comprises one or more "layers", and each of these "layers" comprises a modified Kraus antenna array. The subarray 10 can be fed either at one or more of the feedpoints A (at the intersection of a long and a short side of any of the rectangles 12) with a high impedance unbalanced feed, or at one or more of the feedpoints B (at the midpoints of the short sides 16 of any of the rectangles) with a low impedance balanced feed. Subarray 10 is horizontally polarized (that is, the radiating elements are the short sides 16 of the rectangles 12, and the currents in the elements are of the instantaneous senses indicated by the arrows). Each short side 16 of the rectangles is approximately ½λ in length with respect to the wavelength λ of the antenna feed, and each long side 18 of the rectangles is approximately λ in length. Since the voltages are equal and the currents are zero at the endpoints of the radiating elements, there is no need to provide vertical transmission wires (dashed lines 14) at the outside edges of the array. Thus, the basic Kraus array has been modified by removing these outside transmission elements. FIG. 2B shows a modified vertically polarized Kraus antenna subarray 20, which is identical to the antenna subarray of FIG. 2A except that the radiating elements are oriented in the vertical direction. In other words, the radiating elements of FIG. 2B are rotated 90° in space with respect to the radiating elements of FIG. 2A.

Figure 3:
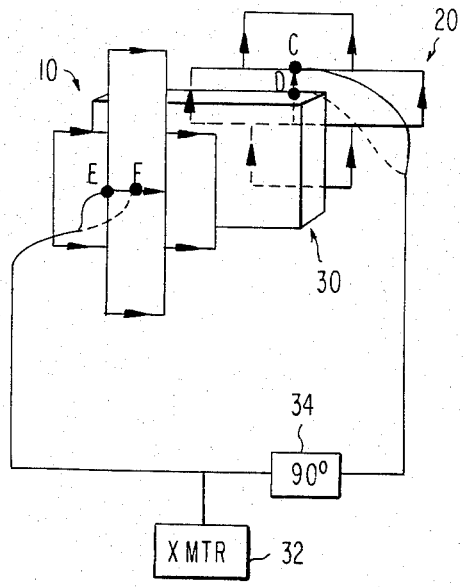
FIG. 3 is a perspective view of the first embodiment of the present invention.

The first embodiment of the present invention is shown in FIG. 3. The horizontal subarray 10 and the vertical subarray 20 are stacked and are insulated from each other by a relatively thin dielectric 30. The antenna can be fed from the transmitter 32 with either a high impedance unbalanced feed (as shown by the solid feed lines) or by a low impedance balanced feed (as shown by the dashed feed lines). The high impedance unbalanced feed lines are connected to points C and E at the corners of the rectangular elements of the subarrays 10 and 20, respectively. The low impedance balanced feed lines, on the other hand, are connected to points D and F at the broken centers of the radiating elements of the subarrays 10 and 20, respectively. Subarray 10 is fed in phase quadrature with respect to subarray 20, as indicated by the 90° phase shifter 34.

As previously discussed, the interaction of the electromagnetic radiations propagated by the horizontally and vertically polarized radiators produces circularly polarized radiation. Thus, by stacking a plurality of Kraus arrays and rotating them 90° with respect to one another, I have made an antenna which is capable of propagating circularly polarized radiation. The antenna of the present invention thus operates as a plurality of discrete crosspolarized radiators, except that the transmission line elements are integral to the array of radiators, thereby decreasing the number of external feed lines which is necessary in such conventional antennas. Further, I have found that, by stacking a plurality of Kraus arrays and displacing them in a particular manner, tighter coupling between the transmission line elements is achieved, and the cancellation of radiation propagated by the transmission line elements should be enhanced thereby. This stacking and displacement of Kraus arrays also enchances the density of radiating elements within a given antenna area.

Figure 4A:
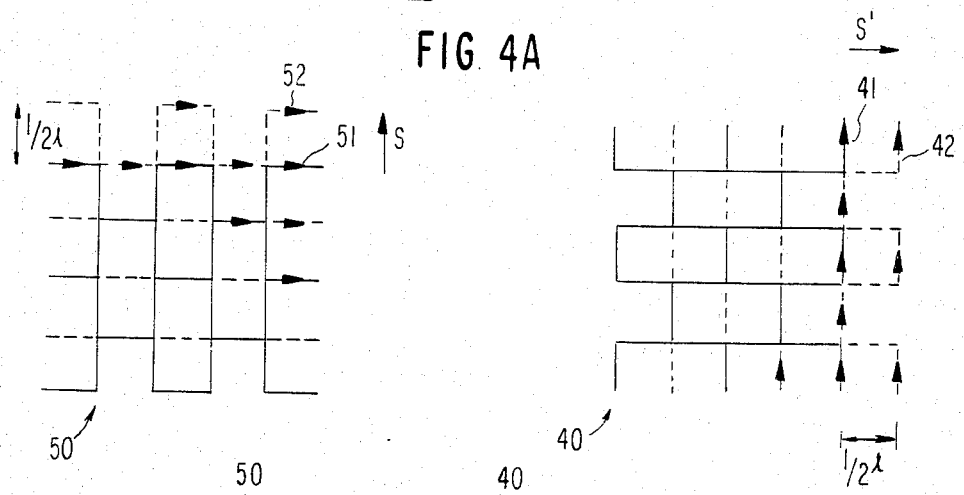
FIG. 4A is a schematic diagram of the subarrays of a second embodiment of the present invention.
Figure 4B:
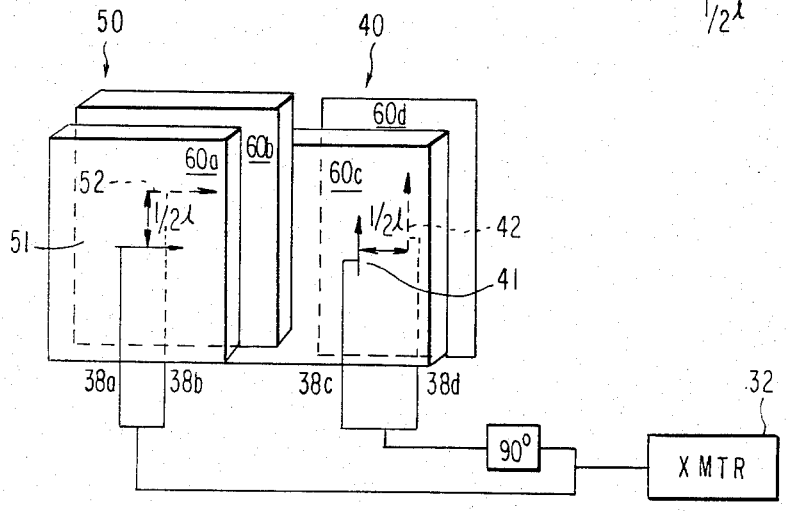
FIG. 4B is a combined perspective and schematic view of an antenna system including the second embodiment of the present invention.
Figure 4C:
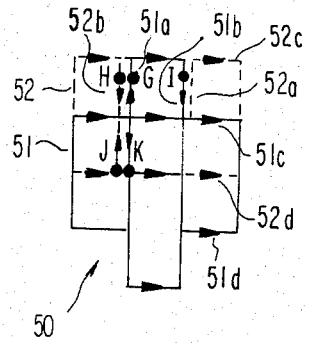
FIG. 4C is an expanded view of the horizontally polarized subarray of the second embodiment of the invention.

A second embodiment of the present invention is shown in FIGS. 4A–4C, wherein each subarray of the cross polarized wire grid antenna comprises two layers of modified Kraus antenna arrays. In FIG. 4A, subarray 40 is made up of vertically polarized layers 41 and 42, and subarray 50 is made up of horizontally polarized layers 51 and 52. In FIG. 4A, each layer of a subarray is shifted ½λ perpendicular to the direction of polarization of the subarray with respect to the other layer of the subarray. In other words, each layer of a subarray is displaced one half the length of a long side with respect to the other layer of the subarray. Thus, vertically polarized layer 42 of subarray 40 is shifted ½λ in the horizontal direction with respect to vertically polarized layer 41, as indicated by arrow S'. Likewise, horizontally polarized layer 52 of subarray 50 is shifted ½λ in the vertical direction with respect to horizontally polarized layer 51 of subarray 50, as indicated by arrow S.

As shown in FIG. 4B, all four layers comprising two subarrays are mounted on the same mounting plate **60*d*, and are insulated from one another by thin layers of dielectric material 60*a*, 60*b*, and 60*c***. Each layer is fed in phase with respect to the other layer of the same subarray, in order to maintain the proper in-phase relationship between the layers.

Thus, I have disclosed an antenna, propagating circularly polarized electromagnetic radiation, which is made up of four layers of modified Kraus array antennas. In addition to producing a circularly polarized antenna having the high radiating element density and single feed point advantages of the Kraus structure, I have provided an antenna which enhances several of the properties of the Kraus array. For instance, as shown in FIG. 4C, by displacing layers within a subarray $\frac{1}{2}\lambda$ perpendicular to the direction of polarization, the density of radiating elements has been effectively doubled. Specifically, four radiating elements 51*c*, 51*d*, 52*c* and 52*d* are within the same antenna area previously occupied by only the two radiating elements 51*c* and 51*d*. In addition, as shown in FIG. 4C, such an arrangement provides closer coupling of the transmission line currents. Specifically, the current in transmission line element 51*a* at point G is equal and opposite to both the current at point I of transmission line element 51*b* and the current at point H of transmission line element 52*b*. Since element 52*b* is closer to 51*a* than is element 51*b*, tighter coupling of the transmission line currents is achieved.

Figure 5:
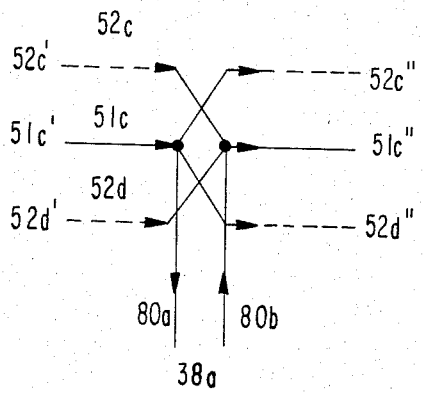
FIG. 5 is a schematic diagram of a second feed-providing alternative for the second embodiment of the invention.
Figure 6:
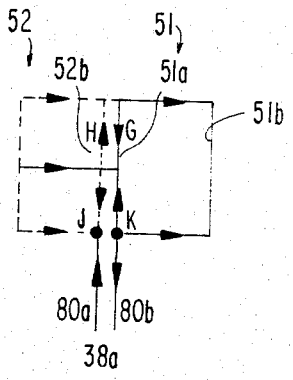
FIG. 6 is a schematic diagram of a third feed-providing alternative for the second embodiment of the invention.

The two-layer subarrays of the present invention may be fed in any one of three feed-providing alternatives. In a first feed-providing alternative, the four feed lines 38*a*, 38*b*, 38*c* and 38*d* as shown in FIG. 4B are connected to one corner of a rectangular element in each of the layers 51, 52, 41 and 42, respectively. It is preferred that the feed lines be connected to similar corners of similar rectangles within each subarray layer. In the second feed-providing alternative, the feed lines 38*a* and 38*c* are connected to layers 51 and 41, respectively, to provide balanced feed to the subarrays 50 and 40, respectively, in a manner as shown in FIG. 5. As previously described, in order to provide balanced feed at the center of a radiating element, the element must be broken at the center, and each remaining portion thereof must be connected to each of the two wires of a two-wire conductor. Thus, balanced feed is provided to the subarray 50 through two-wire balanced feed means 80*a* and 80*b* of feed line 38*a*. Feed means 80*a* and 80*b* are connected between portions 51*c*′ and 51*c*″ of a radiating element 51*c* within layer 51. The broken center of radiating element 51*c* is then "cross-coupled" as shown to the broken centers of two adjacent radiating elements within layer 52. That is, the first portion 51*c*′ of radiating element 51*c* in layer 51 is connected at its broken end to second portions 52*c*″ and 52*d*″ of the two nearest radiating elements 52*c* and 52*d* of layer 52. In a similar manner, the second portion 51*c*″ of radiating element 51*c* of layer 51 is connected at its broken end to first portions 52*c*′ and 52*d*′ of the two adjacent radiators 52*c* and 52*d* of layer 52. Alternatively, this cross-coupling arrangement can be carried out with only one radiator from subarray 52; however, a coupling arrangement with two radiators is preferred in order to maintain the balanced radiation of the antenna. An analogous arrangement to that described above can be used to cross-couple layers 41 and 42 of subarray 40. In this manner, both layers of each subarray can be fed by a single external feed line, since this cross-coupling connection maintains the proper inphase relationship between the layers of the subarrays. In other words, with the layers of the subarrays connected as described, feed lines 38*b* and 38*d* of FIG. 4B can be eliminated, and each subarray can be fed by a single external feed line. Finally, in the third feed-providing alternative, balanced feed is provided between adjacent corners of adjacent rectangles. With reference to FIGS. 4C and 6, point J is shown as being the lowermost right-hand corner of a rectangular element in layer 52 (i.e. at the bottom of transmission line element 52*b*), and point K is shown as being the lowermost left-hand corner of an abutting rectangle in layer 51 (i.e. at the bottom of transmission line element 51*a*). With reference to FIG. 6, two-wire balanced feed means 80*a* and 80*b* are connected to points J and K, respectively. Note that the current in feed means 80*a* is always of an opposite instantaneous sense with respect to that of feed means 80*b* (as shown by the arrows in FIG. 6). Thus, in the third feed-providing alternative, a high impedance balanced feed can be provided between the layers of a subarray.

In summary, I have invented a cross polarized wire grid antenna which produces circularly polarized electromagnetic radiation. The structure of the cross-polarized antenna of the present invention enhances the properties of the Kraus wire grid antenna by increasing the concentration of radiating elements within a given area while also increasing the coupling between transmission line elements. Further, the structure of the cross polarized antenna of the present invention is highly versatile, allowing the user to make many structural modifications in order to adapt the antenna for his particular needs, as specified below.

A number of design modifications can be incorporated into the cross polarized wire grid antenna of the present invention. The elements of the subarray need not be uniform dipoles, but can also be of any other configuration (e.g. "bow tie" elements) which retains the transmission line-radiation properties of the rectangular elements of the present invention. The sidelobe performance of the antenna of the present invention can be altered by varying the line thicknesses of selected radiating elements, or raising and/or lowering the impedance of the radiating elements. The electromagnetic radiation produced by the antenna can be steered electrically by varying the frequency of operation or mechanically by adjusting either the radiating or nonradiating element lengths. The antenna can be either planar or curved, and can be used either as a traveling wave device or as a resonant radiating structure.

It is to be understood that these and other obvious modifications can be made to the disclosed embodiments of the present invention whose scope is defined by the appended claims.

I claim:

1. A cross polarized wire grid antenna producing electromagnetic radiation of circular polarization, said radiation having a wavelength $\lambda$ substantially at a center frequency of operation of said antenna, said antenna comprising:

a first subarray of radiating elements, comprising a first layer of conductors arranged to form a grid of first rectangular elements, the long sides of which operate essentially as transmission line elements and the short sides of which operate essentially as radiating elements for producing electromagnetic radiation of a first linear polarization, and a second layer of conductors arranged to form a grid of second rectangular elements, the long sides of which operate essentially as transmission line elements and the short sides of which operate essentially as radiating elements for producing electromagnetic radiation of said first linear polarization, said first layer being displaced $\frac{1}{2}\lambda$ with respect to said second layer in a direction perpendicular to the direction of said first polarization;

a second subarray of radiating elements, parallel to said first subarray and rotated 90° with respect to said first subarray, and comprising a third layer of conductors arranged to form a grid of third rectangular elements, the long sides of which operate essentially as transmission line elements and the short sides of which operate essentially as radiating elements for producing electromagnetic radiation of a second linear polarization at an angle of 90° relative to said first linear polarization, and a fourth layer of conductors arranged to form a grid of fourth rectangular elements, the long sides of which operate essentially as transmission line elements and the short sides of which operate essentially as radiating elements for producing electromagnetic radiation of said second linear polarization, said third layer being displaced $\frac{1}{2}\lambda$ with respect to said fourth layer in a direction perpendicular to the direction of said second polarization; and means for feeding electrical current to said first subarray and said second array.

2. The cross polarized wire grid antenna as recited in claim 1, further comprising means for insulating said first layer of conductors from said second layer of conductors, said second layer of conductors from said third layer of conductors and said third layer of conductors from said fourth layer of conductors.

3. The cross polarized wire grid antenna as recited in claim 1, further comprising means for feeding said first subarray in phase quadrature with respect to said second subarray.

4. The cross polarized wire grid antenna as recited in claim 1, further comprising means for feeding said first layer of conductors in-phase with respect to said second layer of conductors.

5. The cross polarized wire grid antenna as recited in claim 1, further comprising means for feeding said third layer of conductors in-phase with respect to said fourth layer of conductors.

6. The cross polarized wire grid antenna as recited in claim 1, wherein said nonradiating elements are of a length of approximately one wavelength at said center frequency of operation, and said radiating elements are of a length of approximately one-half wavelength at said center of frequency of operation.

7. The cross polarized wire grid antenna as recited in claim 4, wherein said first layer of conductors has at least one first radiating feed element and said second layer of conductors has at least two second radiating feed elements adjacent to said first radiating feed element, and wherein said means for feeding said first layer in-phase with respect to said second layer further comprises means for providing balanced feed to said first radiating feed element at a broken center thereof and means for cross-coupling said first radiating feed element to said second radiating feed elements.

8. The cross polarized wire grid antenna of claim 5, wherein said third layer of conductors has at least one third radiating feed element and said fourth layer of conductors has at least two fourth radiating feed elements adjacent to said third radiating feed element, and wherein said means for feeding said third layer in-phase with respect to said fourth layer further comprises means for providing balanced feed to said third radiating feed element at a broken center thereof, and means for cross-coupling said third radiating feed element to said fourth radiating feed elements.

9. The cross polarized wire grid antenna as recited in claim 1, wherein each of said grids has a plurality of U-shaped elements and a plurality of outermost rectangular elements abutting said U-shaped elements, each of said U-shaped elements having a first short side, a second short side, and a long side connected to said short sides, said long side of each of said U-shaped elements comprising a portion of one of said long sides of one of said outermost rectangular elements.

10. The cross polarized wire grid antenna array as recited in claim 1, wherein said antenna is driven with respect to a ground plane.

11. The cross polarized wire grid antenna array as recited in claim 1, wherein said subarrays are either planar or curved.

12. The cross polarized wire grid antenna array as recited in claim 1, wherein the width of said radiating and nonradiating elments are not equal.

13. The cross polarized wire grid antenna array as recited in claim 1, wherein the impedances of said radiating elements are not equal.

14. A method for producing circularly polarized electromagnetic waves, comprising the steps of arranging a plurality of conductors to form a first grid of rectangles;

feeding said first grid of rectangles so that the short sides thereof operate essentially as radiating elements producing electromagnetic radiation of a first linear polarization and the long sides thereof operate essentially as transmission line elements;

arranging a plurality of conductors to form a second grid of rectangles;

feeding said second grid of rectangles 90° out of phase with respect to said feed to said first grid of rectangles so that the short sides thereof operate essentially as radiating elements producing electromagnetic radiation of a second linear polarization orthogonal to said first polarization and the long sides thereof operate essentially as transmission line elements;

arranging a plurality of conductors to form a third grid of rectangles;

displacing said third grid of rectangles with respect to said first grid of rectangles by a displacement equal in length to one half the length of a long side thereof in direction perpendicular to an axis of said short side;

feeding said third grid of rectangles so that the short sides thereof operate essentially as radiating elements producing electromagnetic radiation of said first polarization and the long sides thereof operate essentially as transmission line elements, said third grid of rectangles being excited in-phase with respect to said first grid of rectangles arranging a plurality of conductors to form a fourth grid of rectangles;

displacing said fourth grid of rectangles with respect to said second grid of rectangles by a displacement equal in length to one half the length of a long side thereof in a direction perpendicular to an axis of said short side; and feeding said fourth grid of rectangles so that the short sides thereof operate essentially as radiating elements producing electromagnetic radiation of said second polarization and the long sides thereof operate essentially as transmission line elements, said fourth grid of rectangles being excited in-phase with respect to said second grid of rectangles.

15. The method of producing a cross polarized wire grid antenna as recited in claim 14, wherein said steps of feeding said third grid of rectangles and feeding said first grid of rectangles further comprise the steps of:

breaking at least one of said short sides of one of said rectangles of said first grid of rectangles at a center thereof to form a first broken short side having a first portion and a second portion;

breaking at least two of said short sides of one of said third rectangles at centers thereof to form at least two third broken short sides, each of which having a first portion and a second portion;

connecting said first portion of said first broken short side to said second portions of said second broken short sides at adjacent ends thereof;

connecting said second portion of said first broken short side to said first portions of said second broken short sides at adjacent ends thereof; and feeding said first broken short side with balanced feed at said first portion and said second portion at adjacent ends thereof.

16. The method of producing a cross polarized wire grid antenna as recited in claim 14, wherein said steps of feeding said fourth grid of rectangles and feeding said second grid of rectangles further comprise the steps of:

breaking at least one of said short sides of one of said rectangles of said fourth grid of rectangles at a center thereof to form a fourth broken short side having a first portion and a second portion;

breaking at least two of said short sides of one of said second rectangles at centers thereof to form at least two second broken short sides each of which having a first portion and a second portion;

connecting said first portion of said fourth broken short side to said second portions of said second broken short sides at adjacent ends thereof;

connecting said second portion of said fourth broken short side to said first portions of said second broken short sides at adjacent ends thereof; and feeding said fourth broken short side with balanced feed at said first portion and said second portion at adjacent ends thereof.

17. A circularly polarized antenna, comprising:

a first layer of rectangular elements, each of said rectangular elements having two long sides and two short sides, said rectangular elements being interconnected and arranged into a grid comprising a plurality of rows and alternately staggered columns, said grid being electrically excited such that each of said long sides of said rectangular elements operate essentially as transmission line elements and each of said short sides of said rectangular elements operate essentially as radiating elements for radiating electromagnetic radiation of a first linear polarization, and a second layer of rectangular elements parallel to said first layer, each of said rectangular elements having two long sides and two short sides, said rectangular elements being interconnected and arranged into a grid comprising a plurality of rows and alternately staggered columns, said grid being electrically excited such that each of said long sides of said rectangular elements operate essentially as transmission line elements and each of said short sides of said rectangular elements operate essentially as radiating elements for radiating electromagnetic radiation of a second linear polarization in time quadrature with respect to said first polarization, said radiating elements of said second layer being orthogonal to said radiating elements of said first layer, said electrical excitation of said first layer being in phase quadrature with respect to said electrical excitation of said second layer, and said electromagnetic radiations of said radiating elements of both of said layers being equal in magnitude.

* * * * *